US005829150A

United States Patent [19]

McEligot

[11] Patent Number: 5,829,150

[45] Date of Patent: Nov. 3, 1998

[54] CUTTING GUIDE AND METHOD OF MAKING AND USING

[76] Inventor: Mace B. McEligot, 106 Manito Rd., Manasquan, N.J. 08736

[21] Appl. No.: 739,526

[22] Filed: Oct. 29, 1996

[51] Int. Cl.[6] ..... B43L 13/02

[52] U.S. Cl. ..... 33/562; 33/17 R; 33/484; 33/563; 83/56

[58] Field of Search ..... 33/1 G, 11, 12, 33/13, 14, 16, 17 R, 32.1, 32.2, 42, 484, 562, 563, 565, 758, 623; 83/13, 42, 56

[56] References Cited

U.S. PATENT DOCUMENTS

| | | | |
|---|---|---|---|
| 2,410,696 | 11/1946 | Wheeler | 33/484 |
| 2,610,413 | 9/1952 | Dasey | 33/17 R |
| 3,089,802 | 5/1963 | Coffman et al. | 33/562 |
| 3,621,579 | 11/1971 | Dubitsky | 33/11 |
| 3,968,574 | 7/1976 | Ellis | 33/1 G |
| 4,353,759 | 10/1982 | Stallings | 33/563 |
| 4,659,409 | 4/1987 | Arafat | 33/12 |
| 4,930,382 | 6/1990 | Collins | 33/17 R |
| 5,076,612 | 12/1991 | Nirmel | 33/563 |
| 5,471,749 | 12/1995 | Brady | 33/484 |
| 5,557,996 | 9/1996 | Reber et al. | 33/563 |
| 5,579,670 | 12/1996 | McCormick | 83/56 |

*Primary Examiner*—G. Bradley Bennett
*Attorney, Agent, or Firm*—Seed and Berry LLP

[57] ABSTRACT

A method for making a cutting guide, the cutting guide being formed from a measuring device and a sheet of material, with the measuring device having a top surface, a bottom surface, and p of graduations marked on one or the other of the top and bottom surfaces, with the sheet of material having a thickness in the range of 1 mm. to 5 mm. and further having adhesive on one side. The method includes measuring at least one cutting line on the step of material in accordance with predetermined dimensions; cutting the sheet of material along the cutting line to form of at least one piece of material having the predetermined dimensions; and forming a mechanical stop on the bottom surface of the measuring device by placing the adhesive side of the piece of material on the bottom surface of the measuring device. The cutting guide is formed from a base having a substantially plainer configuration with a top surface, and opposing bottom surface, and a sufficient thickness to guide a cutting tool along a side of the base and inhibit the cutting tool from riding over the top surface of the base; and one or more repositionable pieces of at least semiridged material removable attached to the bottom surface of the base.

18 Claims, 8 Drawing Sheets

CUTTING GUIDE AND METHOD OF MAKING AND USING

TECHNICAL FIELD

The present invention pertains to guides for measuring, marking, and cutting a workpiece, and, more particularly, to a cutting guide for fabric and the like having repositionable stops attached to a measuring device to form a template, and methods for making and using the same.

BACKGROUND OF THE INVENTION

Those who quilt, sew, or are involved in home crafts rely on rulers and other similar measuring devices for accurate measuring and marking of a workpiece. The increasing use of rotary cutters to cut material, especially fabric, has resulted in a need for measuring devices that can guide a rotary cutter in a straight line.

One such measuring device that is readily commercially available is the OMNIGRID® ruler marketed by Omnigrid, Inc., of Burlington, Wash. A detailed description of one embodiment of this ruler can be found in U.S. Pat. No. 4,779,346. Briefly, the ruler is formed from a sheet of transparent plastic material having precision composite lines formed thereon to permit visual detection of the line against multi-colored backgrounds. The thickness of this ruler is approximately three millimeters, which facilitates guiding a rotary cutter along the exposed edges.

There are occasions where multiple pieces of fabric or other workpieces must be cut to identical shapes and dimensions. While existing rulers have served their purpose, they are difficult to use in cutting multiple pieces in identical shapes and dimensions. In particular, such rulers take considerable time to consistently align and hold in place against the workpiece for each measurement and cut. Thus, there is a need for a device that enables rapid and consistent alignment with the workpiece or workpieces. In addition, such a device would not only enable quick alignment, but it would also facilitate holding the ruler in position against the workpiece while the workpiece is being marked and/or cut.

SUMMARY OF THE INVENTION

The present invention is directed to a cutting guide and method of making and using the same. In accordance with one embodiment of the present invention, a method for making a cutting guide is provided, the cutting guide being formed from a measuring device and a sheet of material. The measuring device has a top surface, a bottom surface, and a plurality of graduations marked thereon. The sheet of material, which is ideally formed of a solid, compliant or flexible material, has adhesive on one side. The method comprises the steps of measuring at least one cutting line on the sheet of material in accordance with predetermined dimensions; cutting the sheet of material along the at least one cutting line to form at least one piece of material having the predetermined dimensions; and placing the adhesive side of the at least one piece of material on the bottom surface of the measuring device.

In accordance with another aspect of the present invention, the step of measuring further comprises using the measuring device to measure and mark the predetermined dimensions on the sheet of material.

In accordance with yet another aspect of the present invention, the step of cutting the sheet of material comprises placing the material on a cutting surface and guiding a cutting tool with the measuring device.

In accordance with a further aspect of the present invention, the step of placing the adhesive side of the at least one piece of material on the bottom surface of the measuring device comprises placing the at least one piece of material on the measuring device with a portion of the material projecting beyond the side of the measuring device to facilitate accurate positioning of the at least one piece of material on the measuring device and to further facilitate removal of the at least one piece of material from the measuring device.

In accordance with another embodiment of the present invention, a method for cutting multiple pieces of a workpiece to have uniform dimensions and shapes is provided. The method comprises the steps of forming a cutting guide from a measuring device and sheet of material, the sheet of material having a thickness in the range of one millimeter to five millimeters, such that the measuring device has one or more stops formed thereon for contacting the workpiece to be cut; placing the cutting guide with the one or more stops in abutting relationship with the workpiece to be cut; and cutting the workpiece with a cutting tool and the cutting guide.

In accordance with another aspect of the present invention, the step of cutting comprises using the cutting guide to guide the cutting tool in a predetermined path. In addition, the step of cutting further comprises marking the material to be cut using the exposed sides of the cutting guide as a guide. In accordance with another aspect of the present invention, the step of forming a cutting guide comprises the steps of making a cutting guide as set forth in detail above.

In accordance with yet another embodiment of the present invention, a cutting guide is provide that comprises a base having a substantially planar shape with a top surface and an opposing bottom surface, the base having a sufficient thickness to guide a cutting tool along an exposed side of the base and inhibit the cutting tool from riding over the top surface of the base; and one or more repositionable pieces of material adhesively attached to the base, the pieces of material having a substantially planar shape with two opposing surfaces, one of the surfaces having adhesive material thereon.

In accordance with another aspect of the present invention, the base comprises a measuring device having graduations marked thereon.

In accordance with still yet another aspect of the present invention, the one or more pieces of material are adhesively attached to the base such that a portion of at least one of the one or more pieces of material projects beyond the exposed side of the base to facilitate accurate positioning of the piece of material on the base and to facilitate removal of the one or more pieces of material from the base.

In accordance with yet another aspect of the present invention, the cutting guide further includes a removal tab associated with the one or more pieces of material to facilitate placement and lifting of the one or more pieces of material.

As will be readily appreciated from the foregoing, the present invention provides a unique combination of repositionable stops adhesively attached to a measuring device. These stops can be custom made from a sheet of material and are easily attached and repositioned, thus enabling a user to create a template that facilitates rapid and consistent measuring, marking, and cutting of multiple work pieces having uniform dimensions and shape. The stops are of sufficient thickness to not only enable the accurate positioning of the cutting guide but to assist in holding the cutting guide in place against the workpiece during marking and cutting operations.

BRIEF DESCRIPTION OF THE DRAWINGS

The foregoing and other features and advantages of the present invention will become more readily appreciated as the same become better understood from the following detailed description when taken in conjunction with the accompanying drawings, wherein.

DETAILED DESCRIPTION

Figure 1:
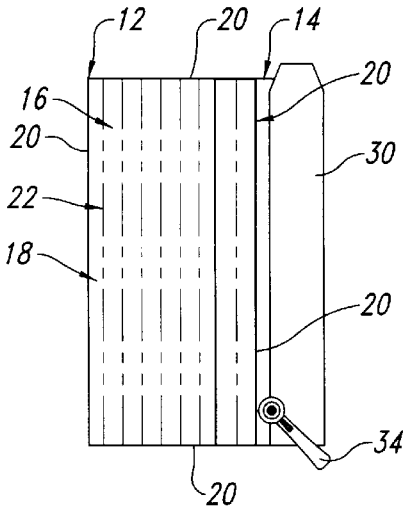
FIG. 1 is an illustration of a measuring device guiding a rotary cutter on a sheet of template material in accordance with the method of the present invention.
Figure 2:
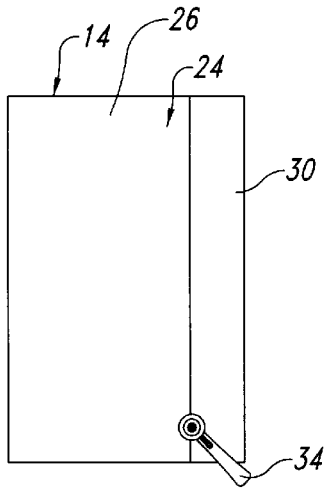
FIG. 2 is an illustration of a rotary cutter trimming excess liner in accordance with the method of the present invention.

Referring initially to FIGS. 1 and 2, illustrated therein are the steps for constructing a cutting guide 10 in accordance with the method of the present invention. The cutting guide 10 is formed from a base material, in this case a transparent measuring device or ruler 12, and a sheet of material 14. Ideally, the base material comprises a transparent measuring device that is readily commercially available on the market. Such devices or rulers 12 are typically formed of transparent plastic material, although other materials may be used, so long as they provide a suitable surface for receiving adhesive material.

As shown in FIG. 1, the ruler 12 has a substantially rectangular shape and is formed of transparent material with a top surface 16, bottom surface 18, and a plurality of exposed edges 20 formed at substantially a right angle to the top and bottom surfaces 16 and 18, respectively. This construction is more readily observable in FIG. 5. A plurality of graduations 22 are formed on the bottom surface 18 of the ruler 12.

As shown more clearly in FIG. 2, the template material 14 comprises a sheet of solid, compliant material, such as plastic, vinyl, styrene, acrylic, rubber, EVA foam and the like. In the preferred embodiment, a material marketed under the brand "Sentra" is being used. However, it is to be understood that even metal or wood could be used as desired. The preference for compliant or flexible material is the ease it provides in lifting and repositioning or removing the material 14 from the ruler 12.

The sheet of material 14 has a top surface 26 and a bottom surface 24. The bottom surface 24 has adhesive material 28 permanently applied thereto that enables the material 14 to be removably connected or attached to the ruler 12. A liner 30 protects the adhesive 28. The adhesive 28 can be a 3M product, such as product number 666 or product number 9425, with a differential tab applied to a clear UPVC film carrier. Other equivalent adhesive material may be used, as will be appreciated by one of skill in this art. A high tack material is placed on the sheet of material 14 and a medium tack is exposed for application on the ruler 12.

In the preferred embodiment, the sheet of material 14 is 1 mm to 5 mm in thickness, although greater thicknesses could be used, depending on the application. Ideally, the thickness is approximately two millimeters. It has been found that the minimum width to which the sheet of material 14 can be cut and be "user friendly" is approximately three-sixteenths of an inch.

In accordance with the method for forming a cutting guide of the present invention, the sheet of material 14 is placed on a cutting surface with the adhesive liner 30 facing upward. The liner 30 is peeled back across a portion of the material 14 to reveal the adhesive 28 on the bottom surface 24. The ruler 1 2 is placed over the adhesive on the bottom surface 24 of the material 14, and aligned with the graduations 22 to create a strip of material or stop 32 having a width corresponding to the selected graduation 22 on the ruler 12. This is shown most clearly in FIG. 1. Once the ruler 12 is adhesively fixed in place, the sheet of template material 14 may be marked for later cutting or cut with a rotary cutting tool 34 as shown. The ruler 12 will act as a guide for the cutting tool 34 as it is rolled across the sheet of template material 14.

After the strip of material 32 has been cut, it can remain attached to the ruler 12 as desired or stored for later use. If stored, the strip of material 32 should have the adhesive 28 protected by a liner or stored on a clean, lint-free piece of plastic or other material. Alternatively, the excess liner 30 shown in FIG. 2 can be trimmed with the rotary cutting tool 34, using the remaining sheet of template material 14 as a guide. The excess liner 30 can then be applied to the strip of material 32 for storage.

It is to be understood that other methods may be used for cutting the strip of material 32, such as first adhering the sheet of material 14 to a cutting surface with several pieces of double-stick tape. The tape will hold the material 14 in place and keep it from slipping while the strip of material 32 is being cut.

Figure 3:
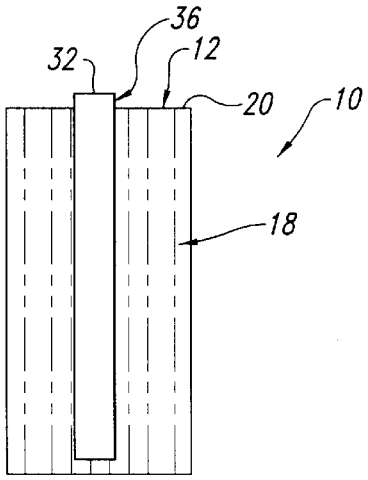
FIG. 3 is a plan form view of a cutting guide having a mechanical stop strip adhesively attached to the bottom surface of a ruler in accordance with the present invention.
Figure 4:
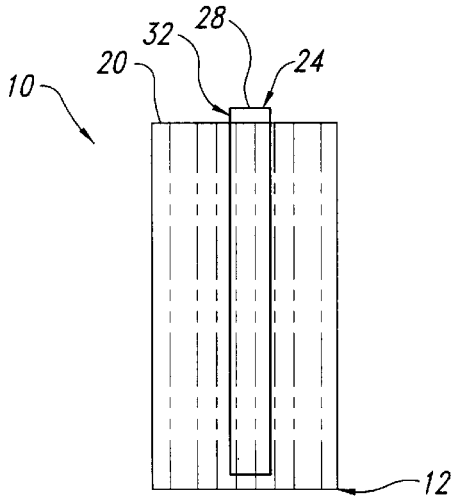
FIG. 4 is a top plan view of the cutting guide of FIG. 3.
Figure 5:
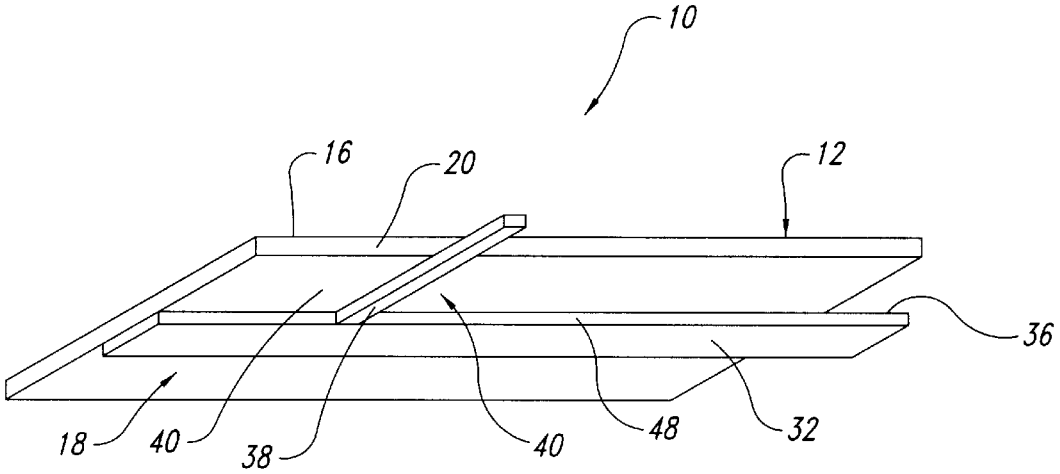
FIG. 5 is an isometric projection of a cutting guide formed in accordance with the present invention.

After the strip of material 32 is cut, it can be applied to the bottom surface 18 of the ruler 12, as shown in FIG. 3. The graduations 22 on the ruler 12 assist in aligning the strip of material 32 to the desired position. As shown in FIGS. 3 and 4, the strip of material 32 may be mounted to have a portion thereof partially extending beyond the edge 20 of the ruler. The extending portion 36 facilitates accurate positioning of the strip of material 32 on the ruler 12 and it also facilitates removal of the strip of material 32 from the ruler 12. Illustrated in FIG. 5 is an alternative embodiment of a cutting guide 10 having a second strip of material 38 attached to the bottom surface 18 of the ruler 12 and in abutting relationship with the first strip of material 32. This in effect creates a rectangular template area 40 on the bottom surface 18 of the ruler 12. The second strip of material 38 also has an extending portion 40 projecting therefrom. However, it is to be understood that these extending portions 36, 40, are optional and need not be used. In addition, a piece of liner 30 may be applied to the exposed adhesive 28 on the extending portions 36, 40, to protect the adhesive and to provide protection from the adhesive 28.

Figure 6:
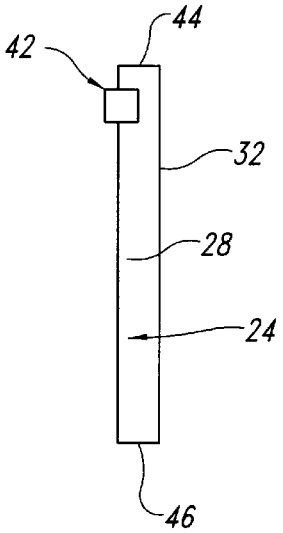
FIG. 6 illustrates a removal tab attached to a stop.
Figure 7:
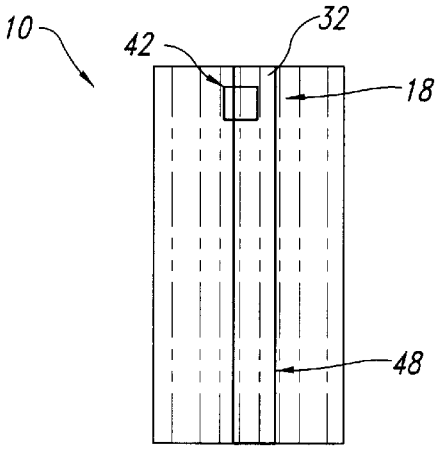
FIG. 7 is a plan form illustration of a cutting guide formed in accordance with an alternative embodiment of the present invention with the removal tab of FIG. 6.

Illustrated in FIGS. 6 and 7 is yet another alternative embodiment of the cutting guide 10, wherein the strip of material 32 includes a removal tab 42 associated therewith. The removal tab 42 is formed by cutting a piece from the sheet of template material 14. For instance, the removal tab 42 may be cut to be three-quarter inches wide by one-half inch long. With the bottom surface 24 of the strip of material 13 facing up to reveal the exposed adhesive 28, the removal tab 42 is placed on the adhesive 28 as shown. Ideally, the removal tab 42 is not placed near the longitudinal ends 44 and 46 in order to leave enough adhesive 28 exposed to assure the strip of material 32 adheres evenly to the ruler 12.

As shown in 47, the strip of material 32 with the removal tab 42 affixed to it is placed on the bottom surface 18 of the ruler 12 with the removal tab 42 facing away from the edge 48 of the strip of material 32 to be used. The strip of material 32 functions as a mechanical stop. In other words, the edge 48 of the strip of material 32 is used to abut against a workpiece to be cut, thus ensuring the workpiece to be cut will have consistent dimensions and that the cutting guide 10 will remain in place during measuring, marking, and cutting of a workpiece.

Figure 8:
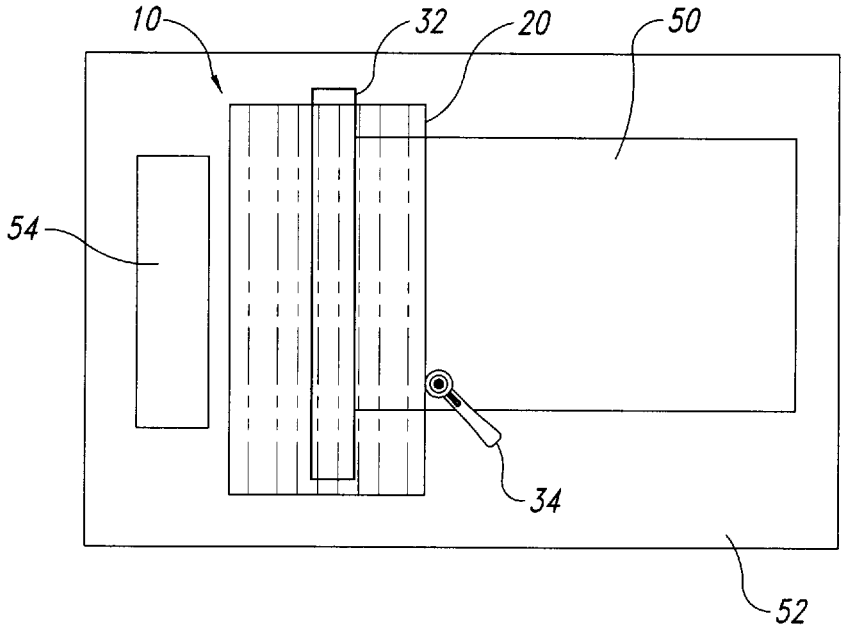
FIG. 8 is an illustration of the cutting guide applied to a workpiece on a cutting mat in accordance with the method of the present invention.

FIGS. 8-12 illustrate various embodiments of the cutting guide 10 in use. Referring first to FIG. 8, a longitudinal strip of material 32 has been applied to the ruler 12, and the edge 48 has been pushed up against a workpiece 50 that is resting on a cutting surface 52. The rotary cutting tool 34 is guided across the workpiece 50 by the edge 20 of the cutting guide 10. The cut pieces 54 will have a uniform width and shape as a result of the positioning of the strip of material 32 or mechanical stop on the bottom surface of the ruler 12. The cutting guide 10 facilitates rapid placement up against the workpiece 50, such as one or more pieces of fabric or other material, increasing the speed with which the workpiece 50 can be measured, marked, and cut.

Figure 9:
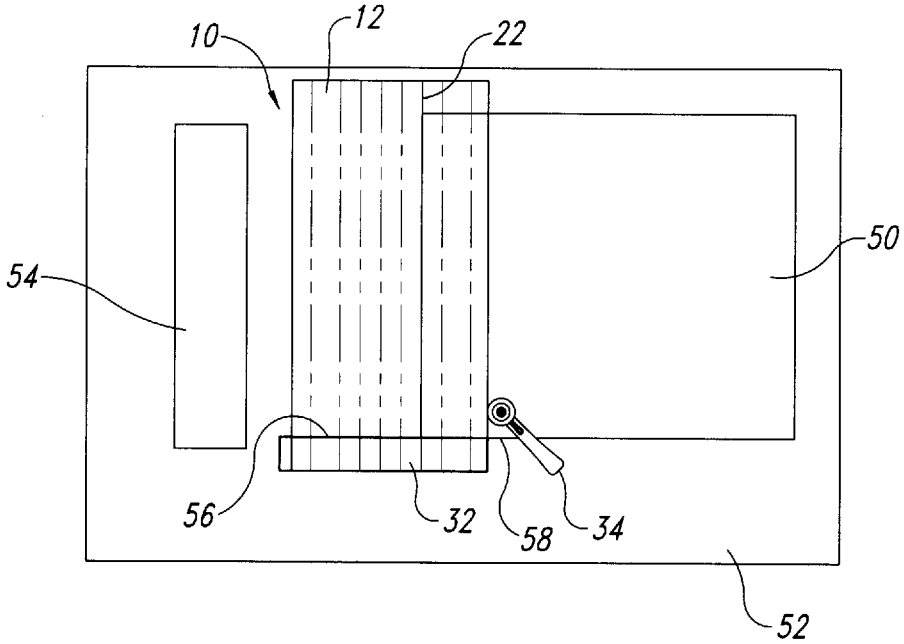
FIG. 9 is an alternative embodiment of a cutting guide applied to a workpiece on a cutting mat in accordance with the method of the present invention.
Figure 10:
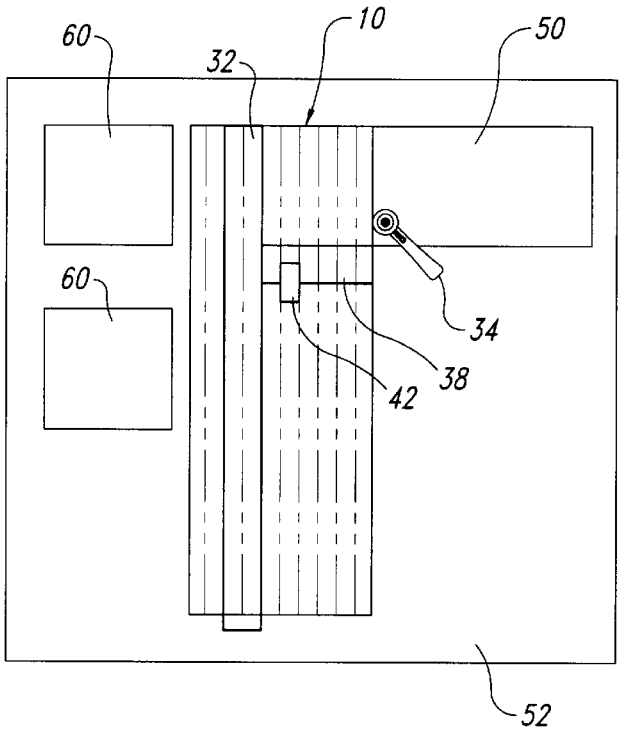
FIG. 10 is another alternative embodiment of a cutting guide applied to a workpiece on a cutting mat in accordance with the method of the present invention.
Figure 11:
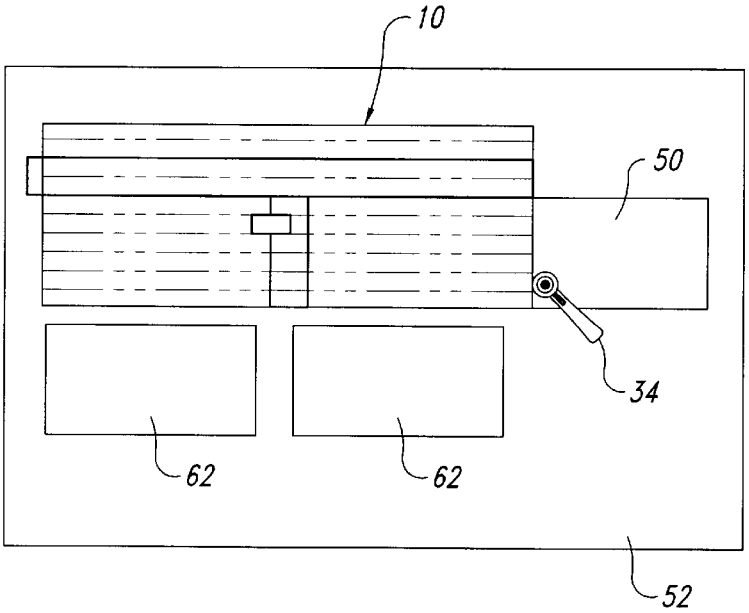
FIG. 11 is yet another alternative embodiment of a cutting guide applied to a workpiece on a cutting mat in accordance with the method of the present invention.
Figure 12:
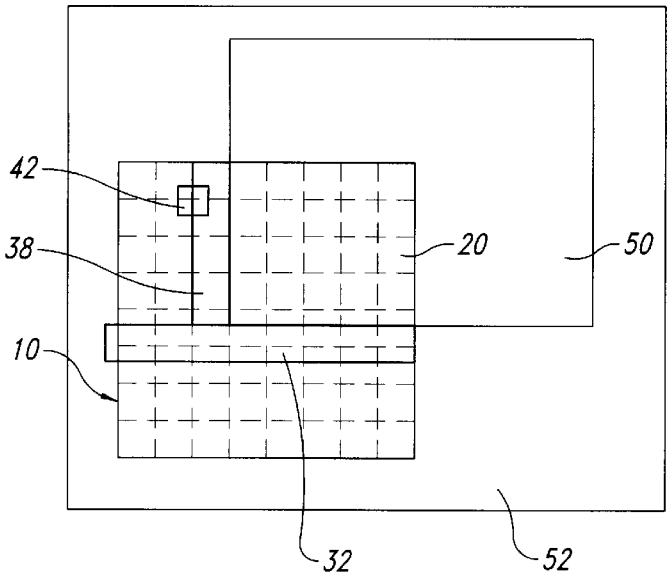
FIG. 12 is a further embodiment of a cutting guide applied to a workpiece on a cutting mat in accordance with the present invention.

Illustrated in FIG. 9 is an alternative embodiment wherein the cutting guide 10 is formed from the ruler 12 and the strip of material 32 placed transversely across one longitudinal end 56 of the ruler 12. In this embodiment, the cut pieces 54 will have the same dimensions as in FIG. 8, but the method for measuring and cutting is slightly different. Here, the cutting guide 10 is slid along one edge 58 of the workpiece 50 while measurement of the width of the cut piece is done visually with the aid of the graduations 22 on the ruler 12. In FIG. 10, the cutting guide 10 of FIG. 5 is applied to a workpiece 50 to form squares 60. Alternatively, the cutting guide 10 may be turned 90° to create rectangles 62 as shown in FIG. 11.

Finally, two cuts can be made at once by positioning the cutting guide 10 at the corner of the workpiece 50 so that two exposed edges 20 of the cutting guide 10 can be used without having to move the cutting guide 10.

The present invention may also be used to cut angles, mark accurate seam lines, increase the size of a pattern, make a square from two rulers, mark a 90° angle, make a longer ruler, and use as a seam guide on a sewing machine.

Figure 13:
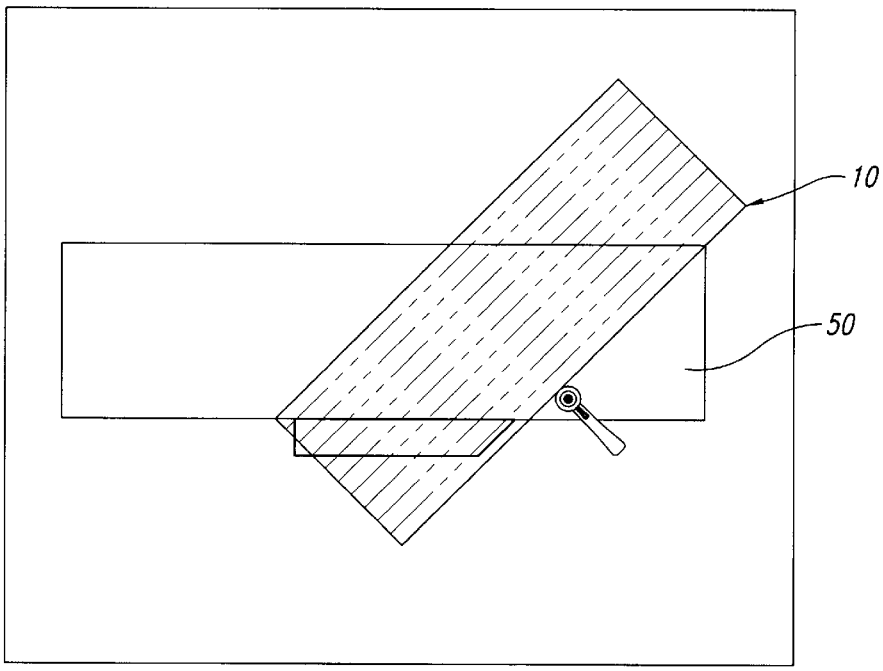
FIG. 13 illustrates yet another embodiment of a cutting guide formed in accordance with the present invention for cutting angles.
Figure 14:
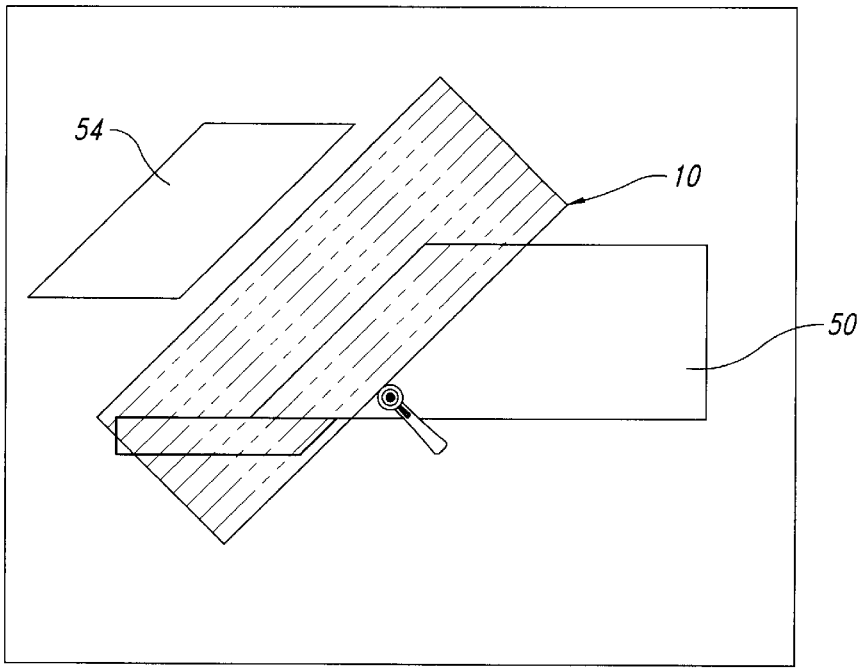
FIG. 14 illustrates the cutting guide of FIG. 13 used to cut parallelograms.

For instance, FIGS. 13 and 14 show the cutting guide 10 with the strip of material 32 placed at a predetermined angle, such as 30°, 45°, or 60°. The cutting guide 10 is placed even with the bottom edge of the workpiece 50 and the angle is cut. FIG. 14 shows cut pieces 54 in the shape of parallelograms using the cutting guide 10 from FIG. 13.

Figure 15:
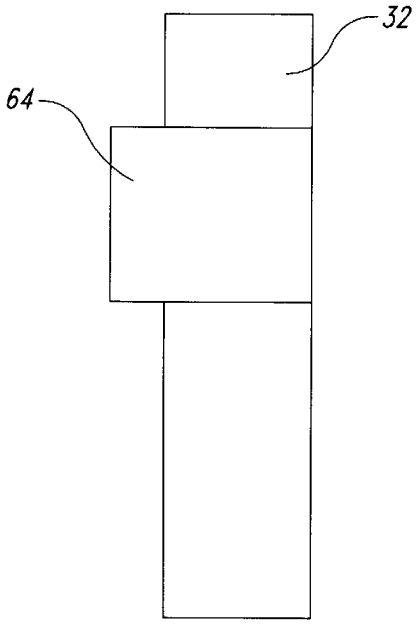
FIG. 15 illustrates the construction of a seam guide for use with sewing machines.
Figure 16:
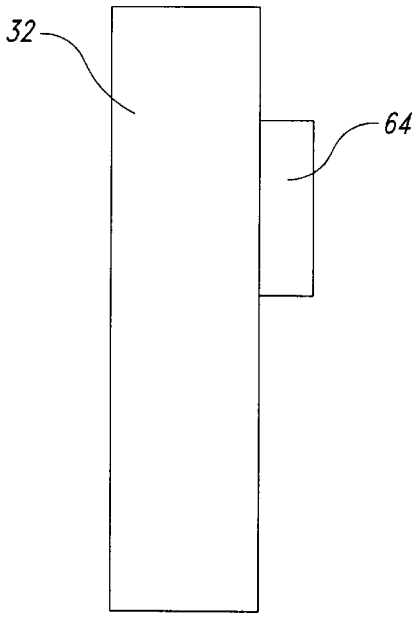
FIG. 16 is the top plan view of the seam guide of FIG. 15.

FIGS. 15 and 16 shows the strip of material 32 and a tab 64 attached thereto. To protect the new wider feed dogs found on modern sewing machines from the adhesive on the strip of material 32, when sewing narrow seams, a removable tab 64 can be constructed having dimensions of approximately one inch (1") in width and a length corresponding to the length of the feed dogs. The tab 64 is placed on the adhesive side of the strip of material 32 with one of its edges aligned with the edge of the strip of material 32, as shown in FIG. 15. The strip of material 32 is then placed on the machine with the adhesive side down and the tab 64 exposed, as shown in FIG. 16. The feed dog area on the sewing machine should be covered by the removable tab 64.

Figure 17:
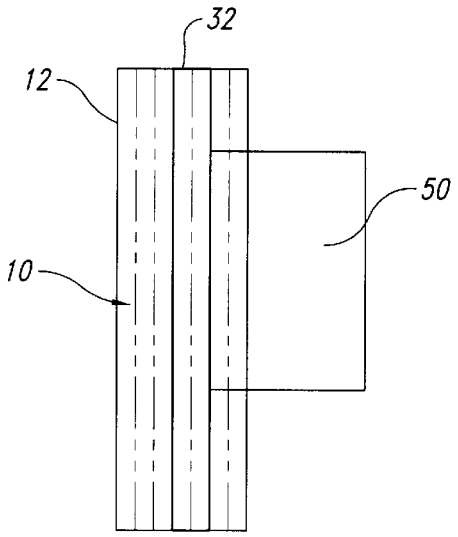
FIG. 17 illustrates the use of a cutting guide for the marking of a seam line.

Shown in FIG. 17 is the use of the cutting guide 10 to mark seam lines. In particular, seam lines from 3/16 of an inch to 1 inch or wider are marked by placing the cutting guide 10 so that the strip of material 32 is on the line indicating the width of the seam allowance on the workpiece 50. The edge of the strip of material 32 is positioned on the edge of the fabric workpiece 50, as shown in FIG. 17. The seam line is then drawn along the edge of the ruler 12. In order to mark seam lines on a curve, short lines are drawn as the cutting guide 10 is move around the curve. The lines are then connected to make the curve.

There will be occasions in sewing and quilting where a pattern does not include a seam allowance or a larger pattern is desired. The present invention accommodates this by cutting a strip of material 32 to the desired extra dimension to be added to a pattern or to the width of the seam allowance (from 3/16 inch to typically 5–1 inch). The edge of the cutting guide 10 which is away from or opposite the cutting or drawing edge would be placed on the pattern line so the pattern would then be drawn or cut along the drawing or cutting edge of the cutting guide 10, thus adding the increased amount.

Figure 18:
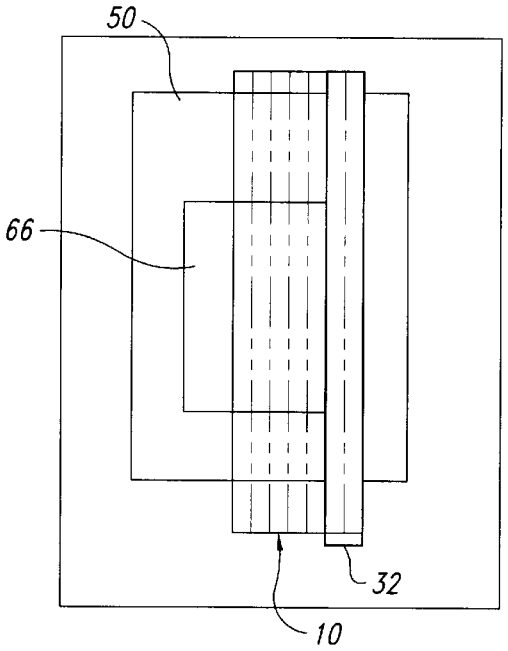
FIG. 18 illustrates the use of the cutting guide to increase the size of a pattern.

Thus, for increasing the size of a pattern, a strip of material 32 is cut to the width of the amount the pattern is to be increased, such as from 3/16 of an inch to 1 inch or wider. The strip of material 32 is placed on the underside or bottom surface 18 of the ruler 12, even with one edge, as shown in FIG. 18. The cutting guide 10 is then placed against the pattern 66 such that the side of the strip of material 32 contacts the pattern 66. A line may then be marked or the workpiece 50 may be cut along the right edge of the cutting guide 10. To draw seam lines on curves, draw short lines as the cutting guide 10 is moved around the curve, then connect the short lines, either by freehand or with the cutting guide 10.

Figure 19:
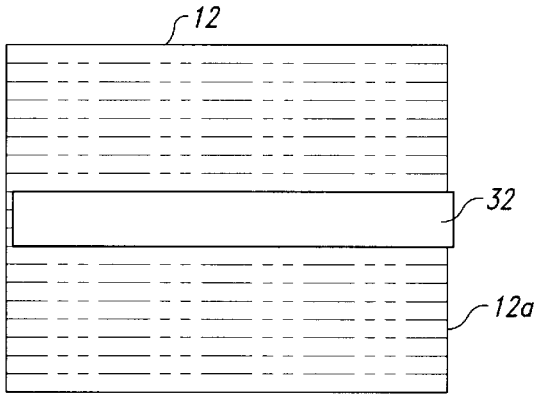
FIG. 19 illustrates the construction of a square using the combination of two rulers formed in accordance with the present invention.

FIG. 19 shows two 6 inch by 12 inch rulers 12, 12*a* attached together with a strip of material 32 to make a square. In this application, a 1 inch wide strip of material 32 is recommended. The adhesive 28 described above is sufficiently strong to hold the two rulers 12, 12*a* together. Rulers of different sizes may also be attached together with this method.

Figure 20:
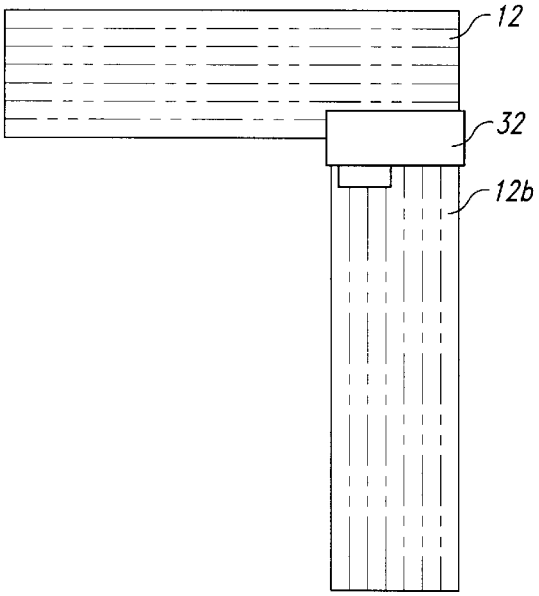
FIG. 20 illustrates an alternative combination of two rulers to form a right angle; and, FIG. 21 illustrates the temporary attachment of two rulers to form an elongate ruler.

Two rulers 12, 12*b* may also be attached at angles to one another, such as at a right angle, as shown in FIG. 20. In this embodiment, the strip of material 32 is placed over the contact point between the rulers to hold them together. Ideally, a 1 inch wide strip of material 32 is used. In addition, the rulers 12, 12*b*, do not have to be the same size.

Figure 21:
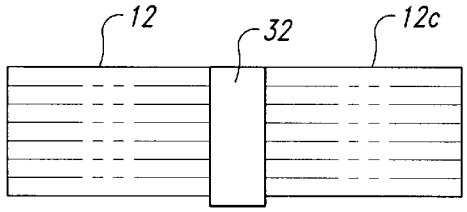

Similarly, two 12 inch rulers 12, 12*c*, may be attached together lengthwise as shown in FIG. 21. Again, a 1 inch wide strip of material 32 is recommended.

It is to be understood that while a preferred embodiment of the invention has been illustrated and described, various changes may be made therein without departing from the spirit and scope thereof. For instance, additional layers of the sheet of template material 14 may be placed on top of each other to form a thicker mechanical stop. In addition, the strip of material 32 may be attached to the cutting surface or a drawing to act as a guide for the ruler 12. Also, one or more strips of material 32 may be placed on the top surface 16 of the ruler 12 to provide a thicker cutting edge, thus preventing "jumping" of the rotary cutting tool 34 onto the top surface 16 of the ruler 12.

Thus, as will be readily appreciated from the foregoing description, the present invention provides a cutting guide utilizing repositionable stops with adhesive that leaves no sticky residue. The material is easily cut to a desired width with a razor knife or a rotary cutter. It can also be cut to a desired length using a cutter or scissors. The present invention is useful for sewing, patchwork, crafts, woodworking, mat making, or any application where accurate cuts or marks are needed.

A cutting guide formed in accordance with the present invention enables a user to cut multiple strips of fabric of any width from one to multiple layers; cut accurate squares or rectangles of fabrics most sizes by using two cutting guides attached together; cut accurate bias strips; help keep the ruler from slipping on a workpiece during cutting or marking operations; keep the edges of the fabric locked in place while cutting; increase paper, cardboard or plastic patterns from 3/16 inches to 5/8 inches or more; mark seam lines of 3/16 inches or more for hand or machine sewing; temporarily attach two or more rulers together to make a square, form right-angles, or other geometric shape; make a T-square from any ruler; make the cutting edge of the ruler thicker to prevent unintentional "jumping" of a rotary cutting tool. In addition, the present invention can be attached to a cutting or drawing surface to act as a guide for a ruler and to act as a seam guide when used in conjunction with a sewing machine. Thus, the scope of the invention is to be limited only by the claims that follow.

The embodiments of the invention in which an exclusive property or privilege is claimed are defined as follows:

1. A method for making a cutting guide, the cutting guide being formed from a measuring device and a sheet of material, the measuring device having a top surface, a bottom surface, and a plurality of graduations marked on one or the other of the top and bottom surfaces, the sheet of material having a thickness in the range of 1 mm to 5 mm and further having adhesive on one side, the method comprising the steps of:

measuring at least one cutting line on the sheet of material in accordance with predetermined dimensions;

cutting the sheet of material along the at least one cutting line to form at least one piece of material having the predetermined dimensions; and forming a mechanical stop on the bottom surface of the measuring device by placing the adhesive side of the at least one piece of material on the bottom surface of the measuring device.

2. The method of claim 1, wherein said step of measuring comprises using the measuring device to measure and mark the at least one cutting line on the sheet of material.

3. The method of claim 1, wherein said step of cutting the sheet of material further comprises placing the sheet of material on a cutting surface and guiding a cutting tool with the measuring device along the at least one cutting line.

4. The method of claim 3, wherein said step of cutting further comprises using a rotary cutting tool to cut the sheet of material along the at least one cutting line.

5. The method of claim 1, wherein said step of placing the adhesive side of the at least one piece of material on the bottom surface of the measuring device further comprises placing the at least one piece of material on the measuring device with a portion of the at least one piece of material projecting beyond the measuring device to facilitate accurate positioning of the at least one piece of material on the measuring device and to facilitate removal of the at least one piece of material from the measuring device.

6. The method of claim 1, comprising the additional step of cutting at least one tab from the sheet of material and placing the at least one tab on the at least one piece of material to facilitate positioning and lifting of the at least one piece of material.

7. A method for cutting one or more pieces of fabric to have uniform dimensions, comprising the steps of:

forming a cutting guide from a measuring device and a sheet of material, the sheet of material being formed of semi-rigid material having a thickness in the range of 1 mm to 5 mm, the sheet of material further having adhesive on one side, the step of forming a cutting guide comprising removably attaching the sheet of material to a bottom surface of the measuring device to form one or more stops on the bottom surface of the measuring device for abutting contact with the fabric to be cut;

placing the cutting guide on the material to be cut with the one or more stops abutting the fabric to be cut; and cutting the fabric with a cutting tool in cooperation with the cutting guide.

8. The method of claim 7, wherein said step of cutting the material comprises using the cutting guide to guide the cutting tool in a predetermined path.

9. The method of claim 7, wherein said step of forming a cutting guide comprises the steps of measuring at least one cutting line in accordance with predetermined dimensions on the sheet of material having adhesive on one side; cutting the sheet of material along the at least one cutting line to form at least one piece of material having the predetermined dimensions; and placing the adhesive side of the at least one piece of material on a surface of the measuring device.

10. The method of claim 7, wherein said step of cutting comprises first marking the material to be cut using the sides of the cutting guide as a guide.

11. The method of claim 10, wherein said step of marking further comprises using the measuring device to measure the predetermined dimensions on the sheet of material.

12. The method of claim 10, wherein said step of cutting the sheet of material comprises placing the material on a cutting surface and guiding a cutting tool with the measuring device along the at least one cutting line.

13. The method of claim 10, wherein said step of placing the adhesive side of the at least one piece of material on a surface of the measuring device further comprises placing the at least one piece of material on the measuring device with a portion of the at least one piece of material projecting beyond the side of the measuring device to facilitate accurate positioning of the at least one piece of material on the measuring device and removal of the at least one piece of material from the measuring device.

14. The method of claim 10, comprising the further step of forming at least one removal tab from the material and attaching the at least one removal tab to at least one piece of material.

15. A cutting guide, comprising:

a base, having a substantially planar configuration with a top surface, an opposing bottom surface, and having a sufficient thickness to guide a cutting tool along a side of said base to prevent the cutting tool from riding over said top surface of said base; and one or more repositionable pieces of at least semi-rigid material removably attached to said bottom surface of said base, each of said one material having a substantially planar shape with two opposing surfaces, one of said surfaces having adhesive material thereon, each of said one or more pieces of material having a thickness in the range of one millimeter to five millimeters.

16. The cutting guide of claim 15, wherein said one or more pieces of material are positioned on said base such that a portion of said one or more pieces of material projects beyond said base to facilitate accurate positioning of said at least one or more pieces of material on said base and to facilitate removal of said one or more pieces of material from said base.

17. The cutting guide of claim 15, wherein said base comprises a transparent measuring device having graduations marked on at least one of said top surface and said bottom surface.

18. The cutting guide of claim 15, further comprising a removal tab adhesively attached to said one or more pieces of material to facilitate repositioning and removal of said one or more pieces of material from said base.

* * * * *